US006698209B1

(12) United States Patent
Gutmark et al.

(10) Patent No.: US 6,698,209 B1
(45) Date of Patent: Mar. 2, 2004

(54) METHOD OF AND APPLIANCE FOR SUPPRESSING FLOW EDDIES WITHIN A TURBOMACHINE

(75) Inventors: Ephraim Gutmark, Baton Rouge, LA (US); Christian Oliver Paschereit, Baden (CH); Wolfgang Weisenstein, Remetschwil (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 09/754,186

(22) Filed: Jan. 5, 2001

(30) Foreign Application Priority Data

Jan. 7, 2000 (DE) ..... 100 00 415

(51) Int. Cl.[7] ..... F02C 7/24
(52) U.S. Cl. ..... 60/776; 60/725; 60/737
(58) Field of Search ..... 60/776, 772, 725, 60/737; 43/1, 114

(56) References Cited

U.S. PATENT DOCUMENTS

| | | | | |
|---|---|---|---|---|
| 4,557,106 A | * | 12/1985 | Ffowcs Williams et al. | 431/1 |
| 4,770,626 A | * | 9/1988 | Zinn | 431/1 |
| 5,408,830 A | | 4/1995 | Lovett | |
| 5,784,889 A | | 7/1998 | Joos et al. | |
| 6,205,764 B1 | * | 3/2001 | Hermann | 60/39.06 |

FOREIGN PATENT DOCUMENTS

| | | |
|---|---|---|
| DE | 43 39 094 A1 | 5/1995 |
| DE | 43 39 094 | 5/1995 |
| DE | 196 36 093 | 3/1998 |
| DE | 198 55 034 A1 | 5/2000 |
| EP | 0 643 267 | 3/1995 |
| EP | 0 754 908 | 1/1997 |
| EP | 0 789 193 | 8/1997 |
| EP | 0 987 491 A1 | 3/2000 |
| EP | 0 987 491 | 3/2000 |
| EP | 0 987 495 | 3/2000 |
| EP | 1 001 214 A1 | 5/2000 |
| WO | 99/37951 | 7/1999 |

OTHER PUBLICATIONS

C.O. Paschereit, I. Wygnanski, and H.E. Fiedler, "Experimental Investigation of Subharmonic Resonance In An Axisymmetric Jet", J. Fluid Mech. (1995), vol. 283, pp. 365–407.

D. Oster and I. Wygnanski, "The Forced Mixing Layer Between Parallel Streams", J. Fluid Mech. (1982), vol. 123, pp. 91–130.

* cited by examiner

*Primary Examiner*—Ehud Gartenberg
(74) *Attorney, Agent, or Firm*—Burns, Doane, Swecker & Mathis, L.L.P.

(57) ABSTRACT

Described are a method of and an appliance for suppressing flow eddies within a turbomachine, having a burner in which a fuel/air mixture is caused to ignite and in which hot gases are formed which leave the burner at the burner outlet and discharge into a combustion chamber, which follows the burner in the flow direction of the hot gases.

The invention is characterized in that a mass flow is mixed into the hot gases directly at the location of the burner outlet.

15 Claims, 4 Drawing Sheets

METHOD OF AND APPLIANCE FOR SUPPRESSING FLOW EDDIES WITHIN A TURBOMACHINE

This application claims priority under 35 U.S.C. §§119 and/or 365 to Appln. No. 100 00 415.6 filed in Germany on Jan. 7, 2000; the entire content of which is hereby incorporated by reference.

BACKGROUND OF THE INVENTION

1. Field of the Invention

The invention relates to a method of and an appliance for suppressing flow eddies within a turbomachine, having a burner in which a fuel/air mixture is caused to ignite and in which hot gases are formed which leave the burner at the burner outlet and discharge into a combustion chamber, which follows the burner in the flow direction of the hot gases.

2. Background Information

During the operation of turbomachines, such as gas turbine installations, undesirable vibrations (so-called thermo-acoustic vibrations) frequently appear in the combustion chambers, which vibrations occur at the burner as fluid mechanics instability waves and lead to flow eddies which strongly influence the whole of the combustion process and lead to undesirable periodic releases of heat, which are associated with strong pressure fluctuations, within the combustion chamber. The high pressure fluctuations involve high vibration amplitudes which can lead to undesirable effects, such as a high mechanical loading on the combustion chamber casing, an increased NO, emission due to inhomogeneous combustion and even to the flame being extinguished within the combustion chamber.

Thermo-acoustic vibrations are at least partially due to flow instabilities in the burner flow, which are expressed by coherent flow structures and influence the mixing processes between air and fuel. In conventional combustion chambers, cooling air is guided over the combustion chamber walls in the manner of a cooling air film. In addition to the cooling effect, the cooling air film also acts in a noise-suppressing manner and contributes to reducing thermo-acoustic vibrations. In modern gas turbine combustion chambers with high efficiencies, low emissions and a constant temperature distribution at the turbine inlet, the cooling air flow into the combustion chamber is markedly reduced and all the air is guided through the burner. At the same time, however, this reduces the noise-suppressing cooling air film so that the noise-suppressing effect is reduced and the problems associated with the undesirable vibrations reappear more powerfully.

A further noise-suppression possibility consists in connecting so-called Helmholtz silencers in the region of the combustion chamber or the cooling air supply. In modern combustion chamber designs, however, the provision of such Helmholtz silencers is associated with great difficulties because of the constricted spatial relationships.

In addition, it is known that the fuel flame can be stabilized by additional injection of fuel and it is therefore possible to oppose the fluid mechanics instabilities appearing in the burner and the associated pressure fluctuations. Such an injection of additional fuel takes place via the head stage of the burner, in which a nozzle located on the burner center line is provided for the supply of the pilot fuel gas; this, however, leads to an enrichment of the central flame stabilization zone. This method of reducing thermo-acoustic vibration amplitudes is, however, associated with the disadvantage that the injection of fuel at the head stage can introduce an increase in the emission of $NO_x$.

More precise investigations of the formation of thermo-acoustic vibrations have shown that such undesirable coherent structures occur during mixing processes. The shear layers, which form between two mixing flows and within which coherent structures are formed, are of particular importance in this connection. More detailed information on this matter can be found in the following publications: Oster & Wygnanski 1982, "The forced mixing layer between parallel streams", Journal of Fluid Mechanics, Vol. 123, 91–130; Paschereit et al. 1995, "Experimental investigation of subharmonic resonance in an axisymmetric jet", Journal of Fluid Mechanics, Vol. 283, 365–407.

As may be seen from the above articles, it is possible to influence the coherent structures which form within the shear layers by the carefully directed introduction of an acoustic excitation in such a way that their occurrence is inhibited. A further method is to introduce a counteracting acoustic field so that the existing undesirable acoustic field is completely extinguished by the carefully directed introduction of a phase-shifted acoustic field. The anti-sound technique, as it is also described, does however require a relatively large amount of energy, which must either be made available externally to the burner system or be branched off from the overall system at another location. This, however, leads to a loss of efficiency which, though small, is still present.

SUMMARY OF THE INVENTION

The invention is based on the object of developing a method of suppressing flow eddies within a turbomachine, in particular a gas turbine installation, having a burner in which a fuel/air mixture is caused to ignite and in which hot gases are formed which leave the burner at the burner outlet and discharge into a combustion chamber, which follows the burner in the flow direction of the hot gases in such a way that the undesirable flow eddies, which are formed as coherent pressure fluctuation structures, should be extinguished efficiently and without the expenditure of large amounts of additional energy. The measures necessary for this purpose should involve little design complication and be of favorable cost in their realization.

An exemplary embodiment of the invention provides for a carefully directed mixing of a mass flow into the hot gases occurring within the burner directly at the location of the burner outlet.

The invention is based on the knowledge that the location for the occurrence of the coherent structures is the interface or shear layer directly at the burner outlet. In contrast to the anti-sound principle, in which an existing acoustic field is extinguished by the introduction of a phase-shifted acoustic field of the same energy, the idea of the invention is based on directly influencing the shear layer it self in which the thermo-acoustic vibrations start to form. By directly influencing the shear layer itself, in the form of a carefully directed injection of a mass flow, preferably of a gaseous mass flow, such as air, nitrogen or natural gas, the mechanisms reinforcing pressure fluctuations and operating in the shear layer can be used in order to extinguish the undesirable pressure fluctuations in a carefully directed manner. Thus even the smallest perturbations, which are introduced from outside into the shear layer in the form of a carefully directed supply of mass flow, are themselves reinforced, by means of which perturbations the undesirable thermo-acoustic vibrations forming in the shear layer can be extinguished. This provides the possibility of completely suppressing the thermo-acoustic vibrations by means of small perturbation signals induced from the outside. Additional energy sources, such as are known from the anti-sound technique, are unnecessary in the method according to the invention.

The method according to the invention therefore permits direct excitation of the shear layer at the location of its occurrence, i.e. at the burner outlet.

Typically, the burner has at least two hollow partial bodies nested one within the other in the flow direction of the hot gases, the center lines of which partial bodies are offset relative to one another so that adjacent walls of the partial bodies form tangential air inlet ducts for the flow of combustion air into an internal space specified by the partial bodies, the burner having at least one fuel nozzle. Such burner types, also designated conical burners, have, at their burner outlet, a circular configuration of a separation edge, at which an outlet duct is provided directly adjacent to the burner end, through which outlet duct the mass flow can be injected into the shear layer forming at the separation edge. The outlet duct is preferably provided on the inside of the burner outlet, directly at its separation edge. In exemplary embodiments of the invention, the outlet duct discharges the mass flow along the contour of the separation edge. The outlet duct can be arranged to discharge the mass flow along the entire separation edge, or along only a part of the separation edge.

In addition to the use of a gaseous mass flow, as indicated above, it is also possible to mix a liquid mass flow into the hot gases, for example in the form of liquid fuel.

In order to specifically suppress the thermo-acoustic vibrations forming within the shear layer at the burner outlet, the mass flow supply has to be introduced into the shear layer as a constant flow or, preferably, a pulsed flow to subsequently mix with the hot gases. For optimum vibration damping results, the pulsation frequency of the mass flow has to be matched to the formation behavior of the undesirable flow eddies or thermo-acoustic vibrations forming within the shear layer. Experience values show that an effective suppression of the undesirable flow eddies is located at pulsation frequencies between 1 and 5 kHz, preferably between 50 and 300 Hz.

It is particularly advantageous for the mass flow feed to take place as a response signal to the thermo-acoustic vibrations forming within the shear layer. This assumes that the formation behavior of the flow eddies within the shear layer is recorded and that a corresponding response or excitation signal is generated as a function of it. This preferably takes place within a closed-loop control circuit, to which is supplied a signal characteristic of the formation of thermo-acoustic vibrations and which generates, as a function of this, an excitation signal by means of which the mass flow to be introduced into the interface is modulated. By means of techniques known per se, it is possible to record the signal characteristic of the formation of thermo-acoustic vibrations within the interface, to correspondingly filter and phase-shift it and to supply it in amplified form to a further control unit, which operates on the basis of the closed-loop control circuit described above.

On the other hand, the excitation signal determining the mass flow feed can also be supplied (for reasons of reduced complication) by a control unit which has no specific phase relationship to the thermo-acoustic vibrations forming within the shear layer. Nevertheless, highly efficient vibration suppression can be achieved in this way.

BRIEF DESCRIPTION OF THE DRAWINGS

Other objects and advantages of the present invention will become apparent to those skilled in the art from the following detailed description of preferred embodiments, when read in conjunction with the accompanying drawings wherein like elements have been designated with like reference numerals and wherein.

DETAILED DESCRIPTION OF THE PREFERRED EMBODIMENTS

Figure 1:
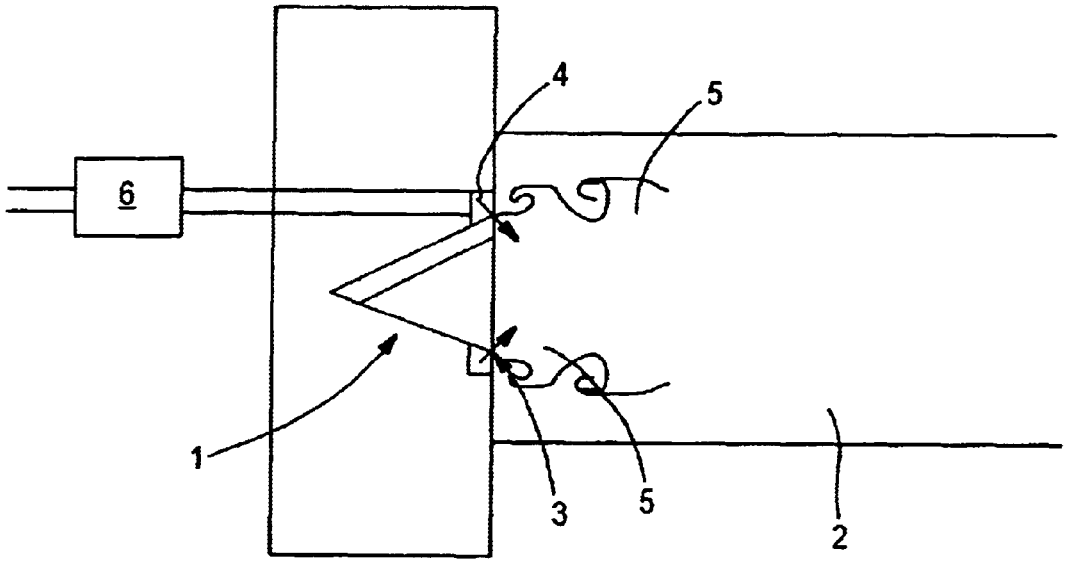
FIG. 1 shows a diagrammatic representation of the excitation appliance configured according to the invention.

FIG. 1 shows a diagrammatic representation of an appliance for the specific suppression of thermo-acoustic vibrations within a combustion system. A conical burner 1, with a combustion chamber 2 directly adjacent in the flow direction, is shown in very diagrammatic fashion. The conical burner 1 has a circular configuration of burner outlet 3 which is, in particular, configured as a sharp separation edge. An outlet duct 4, which extends in circular fashion around the separation edge and through which a mass flow, preferably air or nitrogen, can be specifically discharged (see arrows), emerges on the inside of the burner outlet 3. An interface or shear layer 5, within which the undesirable thermo-acoustic vibrations occur, forms immediately adjacent to the burner outlet 3 in the flow direction. In order to suppress these thermo-acoustic vibrations efficiently, a carefully directed mass flow injection takes place through the outlet duct 4 into the shear layer 5, within which mechanisms strengthening the flow eddies act, and because of this, the perturbations induced by the mass flow in the shear layer are also correspondingly strengthened. A controllable valve 6 ensures that the mass flow can be fed into the shear layer 5 both continuously and in pulses.

It is fundamentally possible to select a specified pulse frequency which has no fixed phase relationship to the thermo-acoustic vibrations forming within the shear layer 5. Within a closed-loop control circuit, however, the valve 6 can specify a pulse frequency which has a certain relationship to the formation behavior of the thermo-acoustic vibrations within the shear layer 5. Thus by means of a suitable choice of a correct phase difference between the pulsation of the mass flow and a measured excitation signal, which characterizes the thermo-acoustic vibrations within the shear layer, the coherence of the developing instability waves can be perturbed, so that the pulsation amplitudes can be decisively reduced. In contrast to the acoustic excitation using the anti-sound technique, no high demands are placed on the excitation mechanism according to the invention, particularly since thermal boundary conditions do not essentially impair the functional capability of the suppression mechanism.

Figure 2:
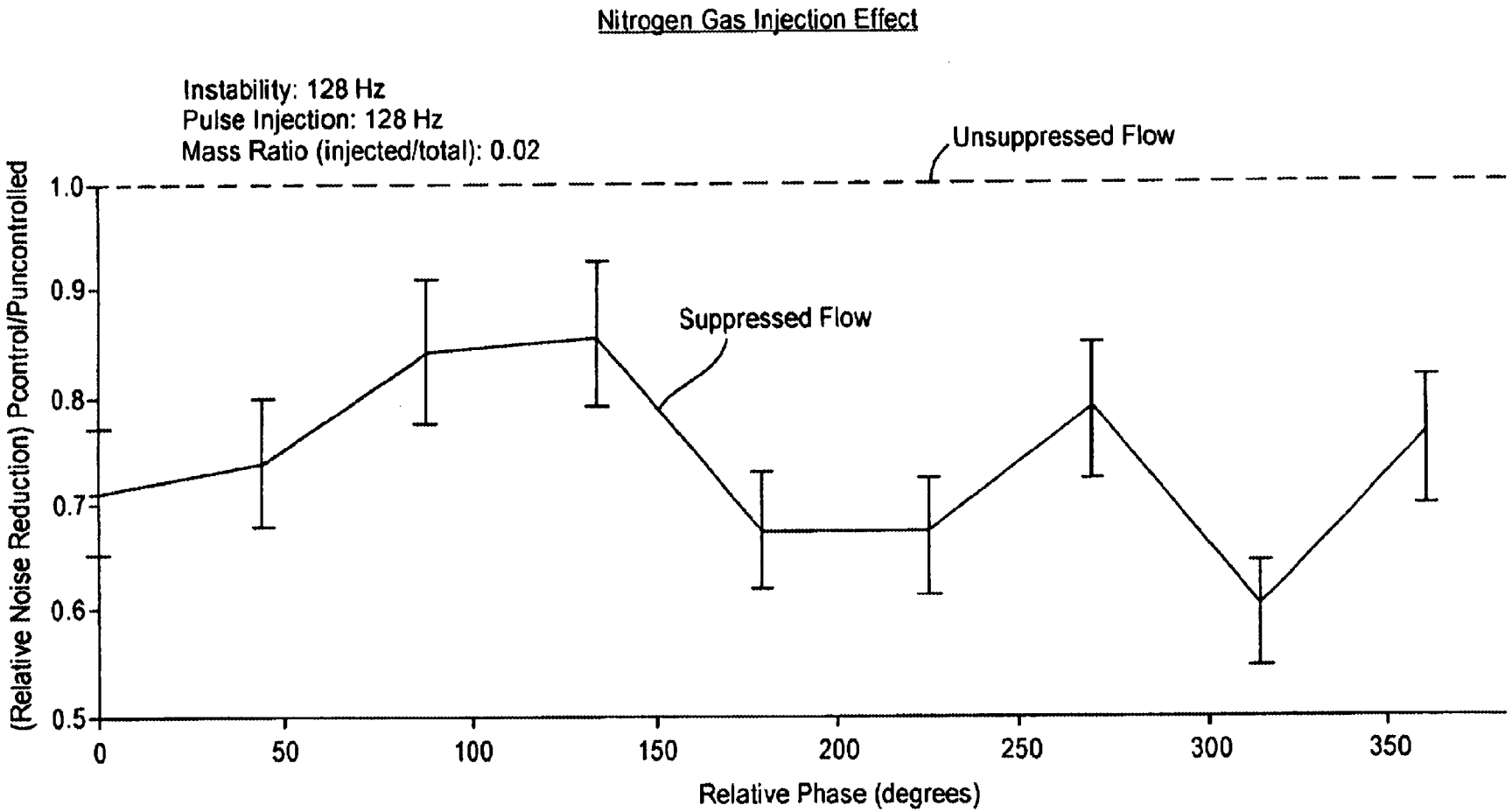
FIG. 2 shows a diagram of the suppression efficiency using a closed-loop control circuit with pulsed injection of nitrogen gas.
Figure 3:
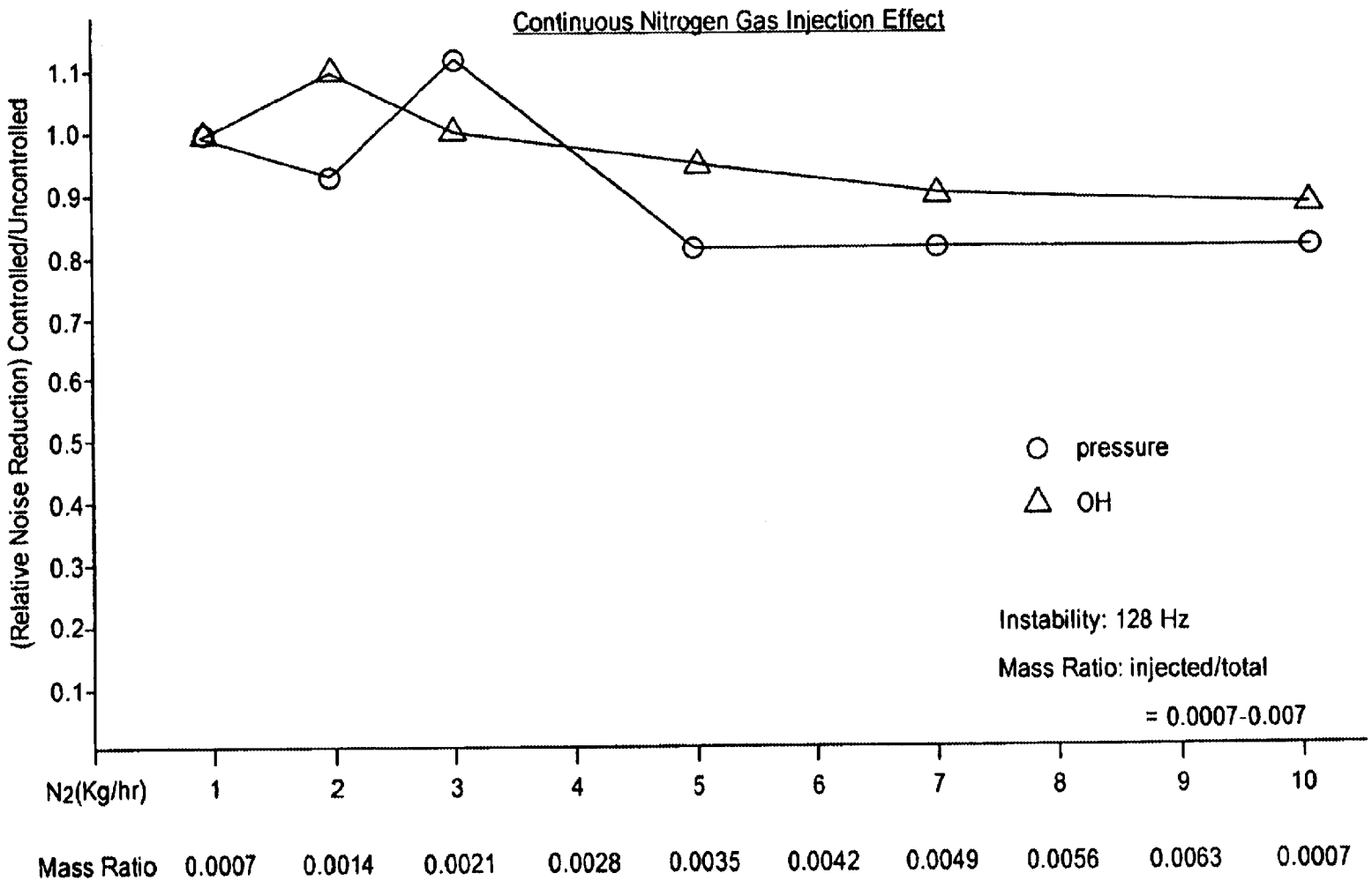
FIG. 3 shows a diagram of the suppression efficiency with continuous injection of nitrogen gas in terms of both measured pressure and measured OH.
Figure 4:
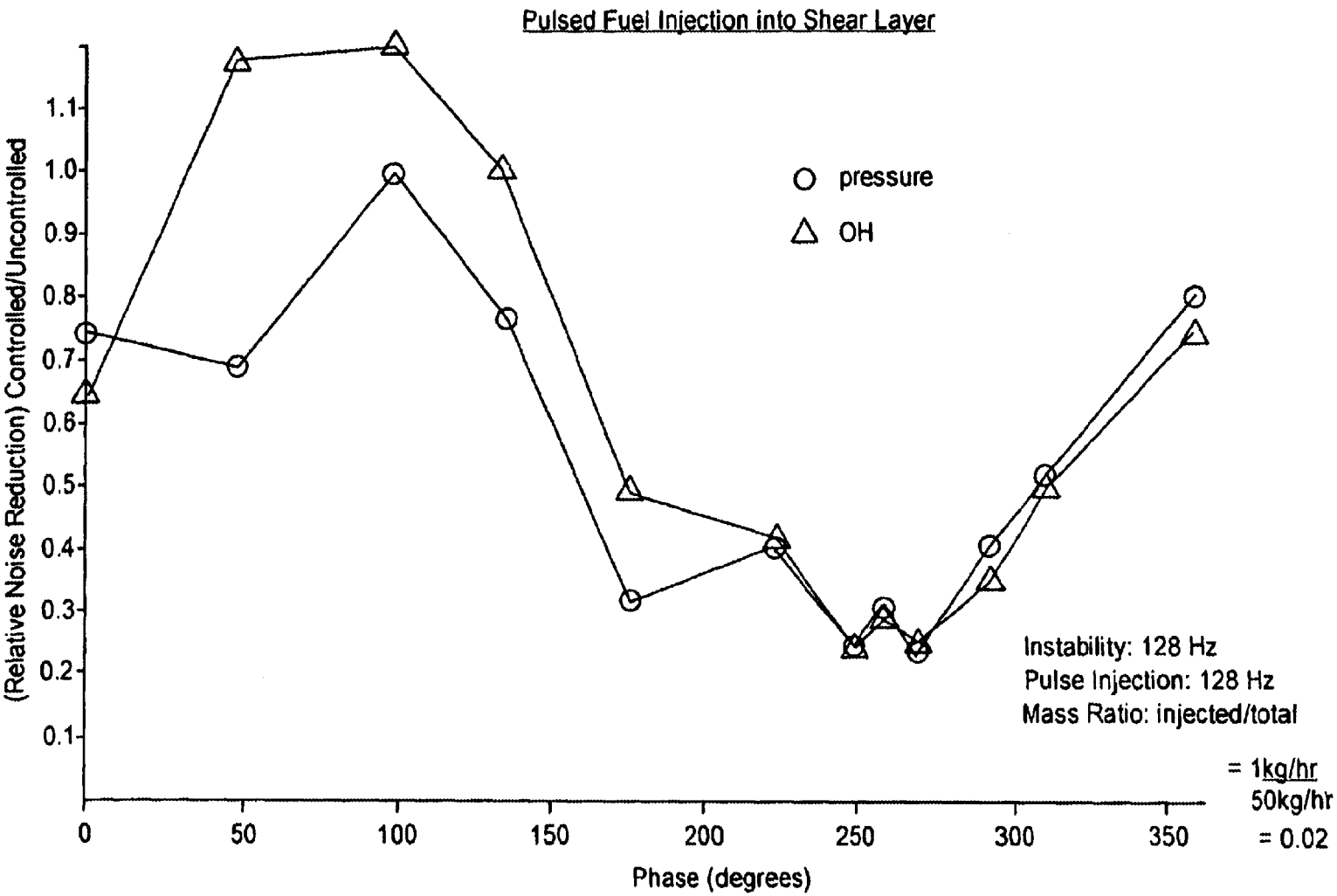
FIG. 4 shows a diagram of the suppression efficiency with pulsed injection of fuel into the shear layer in terms of both measured pressure and measured OH.

The mode of operation of the method according to the invention for suppressing flow eddies within turbomachines can also be seen from the diagram of FIG. 2. The diagram of FIG. 2 is used to compare an unsuppressed flow case (for this, see the dotted line) with a suppressed flow case (for this, see the full lines). This diagram has been taken for a suppression of a pressure vibration in the 100 Hz range. The excitation of the mass flow takes place antisymmetrically relative to the thermo-acoustic vibrations forming within the shear layer. Nitrogen was used for the mass flow.

List of Designations

1 Burner
2 Combustion chamber
3 Burner outlet
4 Outlet duct
5 Shear layer
6 Valve

What is claimed is:

1. A method of suppressing flow eddies within a burning chamber of a turbomachine, the turbomachine having a burner in which a fuel/air mixture is created and led from an outlet of the burner to a combustion chamber, which follows the burner and where the fuel/air mixture is caused to ignite and in which hot gases are formed, wherein a mass flow is mixed from the inside of the burner outlet into a shear layer forming at a separation edge at the burner outlet.

2. The method as claimed in claim 1, wherein the burner is used to generate the, the fuel/air mixture which burner comprises at least two hollow partial bodies nested one within the other in the flow direction of the hot gases, the center lines of which partial bodies are offset relative to one another in such a way that adjacent walls of the partial bodies form tangential air inlet ducts for the flow of combustion air into an internal space specified by the partial bodies, the burner having at least one fuel nozzle.

3. The method as claimed in claim 1, wherein a liquid fuel is used as the mass flow.

4. The method as claimed in claim 1, wherein a gas flow is used as the mass flow.

5. The method as claimed in claim 1 or 2, wherein the mass flow passes into the shear layer over an outlet duct which extends, at least in part, in a circular fashion around the separation edge of the burner outlet.

6. The method as claimed in claim 1 or 2, wherein the mass flow is mixed continuously into the shear layer.

7. The method as claimed in claim 1 or 2, wherein the mass flow is mixed in pulse fashion into the shear layer.

8. The method as claimed in claim 7, wherein the pulsation of the mass flow takes place with a pulsation frequency which is matched to the formation behavior of the flow eddies.

9. The method as claimed in claim 8, wherein the mixing of the mass flow takes place by means of a control unit.

10. The method as claimed in claim 7, wherein the mass flow is mixed into the hot gases with a pulsation frequency which is located between 1 kHz and 5 kHz.

11. The method as claimed in claim 9, wherein the control unit is operated with an open-loop control circuit.

12. The method as claimed in claim 9, wherein the control unit is operated with a closed-loop control circuit and a signal is supplied to the closed-loop control circuit which is characterized by the flow eddies occurring in the turbomachine, and which is used as the excitation signal for the pulsed mass flow.

13. The method as claimed in claim 12, wherein the signal supplied to the closed-loop control circuit is formed by measuring a signal characteristic of the flow eddies, and filtering, phase-shifting and amplifying the measured signal characteristic.

14. The method of claim 4, wherein the gas is air, nitrogen or natural gas.

15. The method of claim 7, wherein the pulsation frequency is located between between 50 Hz and 300 Hz.

* * * * *